United States Patent [19]

Boogers

[11] 4,246,911

[45] Jan. 27, 1981

[54] DEVICE FOR STORING SUBSTANTIALLY SIMILAR TOBACCO LEAF PORTIONS IN A TAPE REEL OR BOBBIN

[75] Inventor: Wilhelmus P. L. Boogers, Eindhoven, Netherlands

[73] Assignee: B.V. Arenco, P.M.B., Best, Netherlands

[21] Appl. No.: 959,224

[22] Filed: Nov. 9, 1978

[30] Foreign Application Priority Data

Nov. 14, 1978 [NL] Netherlands ..... 12517

[51] Int. Cl.[3] ..... A24B 7/00; A24B 7/14

[52] U.S. Cl. ..... 131/149; 198/374; 131/36

[58] Field of Search ..... 131/149, 105, 146, 145, 131/33, 58, 36, 26; 198/374; 83/150

[56] References Cited

U.S. PATENT DOCUMENTS

| | | | |
|---|---|---|---|
| 2,416,173 | 2/1947 | Halstead | 131/149 |
| 3,352,308 | 11/1967 | Lindgreen | 131/20 R |
| 3,542,038 | 11/1970 | Hooper | 131/105 |
| 3,659,620 | 5/1972 | Pietrucci et al. | 131/149 |
| 3,770,112 | 11/1973 | Asfour | 131/149 |
| 3,838,697 | 10/1974 | Boogers | 131/58 |
| 4,128,214 | 12/1978 | Maas | 131/149 |

*Primary Examiner*—V. Millin

*Attorney, Agent, or Firm*—John P. Snyder

[57] ABSTRACT

A device for storing substantially similar tobacco leaf portions in a tape reel or bobbin comprising a cutting station for cutting substantially similar leaf portions from a whole or a half tobacco leaf, a reel for winding a tape, a table for guiding and supporting the tape to be wound and a transport mechanism for transferring tobacco leaf portions from the cutting station to the supporting surface of the table, said device is provided with more than one cutting member for cutting simultaneously more than one leaf portion of the same shape, while the transport mechanism comprises an orientating member for aligning the leaf portions, in order to materially raise the production capacity of said device.

4 Claims, 6 Drawing Figures

DEVICE FOR STORING SUBSTANTIALLY SIMILAR TOBACCO LEAF PORTIONS IN A TAPE REEL OR BOBBIN

The invention relates to a device for storing substantially similar tobacco leaf portions in a tape reel or bobbin comprising a cutting station for cutting substantially similar leaf portions from a whole or a half tobacco leaf, a reel for winding a tape, a table for guiding and supporting the tape to be wound and a transport mechanism for transferring tobacco leaf portions from the cutting station to the supporting surface of the table.

In such a device for storing tobacco leaf portions by means of a tape reel or bobbin it is important for said portions to be brought or stored on the tape with the same orientation in order to facilitate picking up of the portions. Hitherto such devices are equipped with a single cutting mechanism so that each time one tobacco leaf portion is transferred from the cutting station to the winding member. Therefore, the production capacity of such a device is limited by the feed and positioning of a tobacco leaf at the cutting station.

The invention has for its object to materially raise the production capacity of said device. For this purpose the cutting station of the device embodying the invention is provided with more than one cutting member for cutting simultaneously more than one leaf portion of the same shape, whilst the transport mechanism comprises an orientating member for aligning the leaf portions.

The orientating member permits of simultaneously cutting, transferring and delivering to a winding reel differently orientated leaf portions of a tobacco leaf, on which bobbin the leaf portions are arranged with the desired orientation.

In a preferred embodiment the device is constructed so that mirror-symmetrical leaf portions can be processed. This device is distinguished in that the orientating member is formed by an auxiliary table arranged at the side of the table and adapted to pivot about an axis parallel to the supporting face down to said supporting surface, the transport mechanism comprising furthermore a suction head for simultaneously picking up at least one pair of mirror-symmetrical leaf portions from the cutting station and for delivering one leaf portion on the supporting face of the table and the other leaf portion on the auxiliary table.

Figure 2:
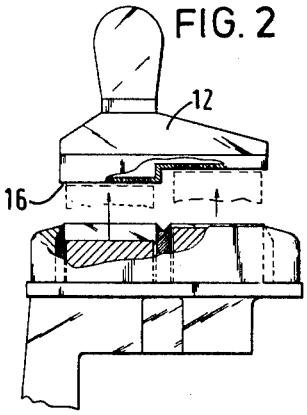
Figure 3:
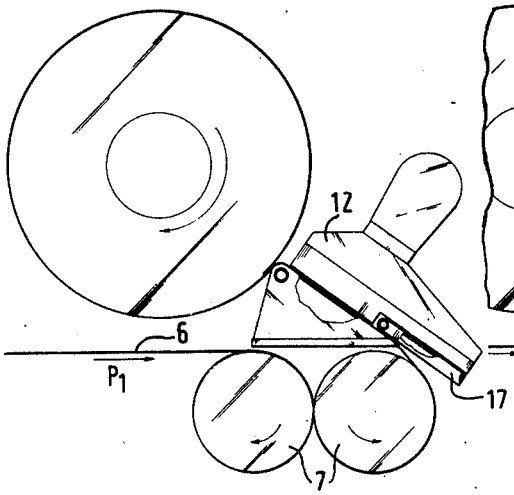
Figure 4:
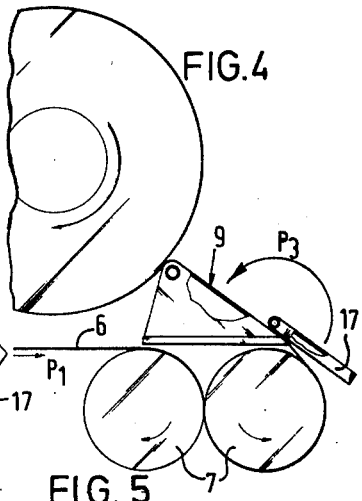
Figure 5:
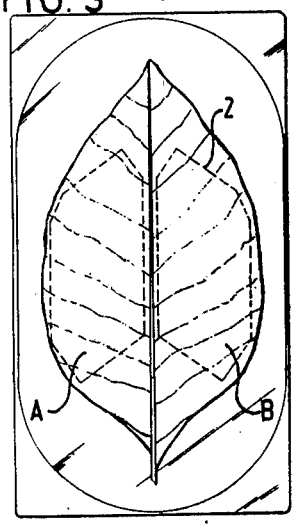
Figure 6:
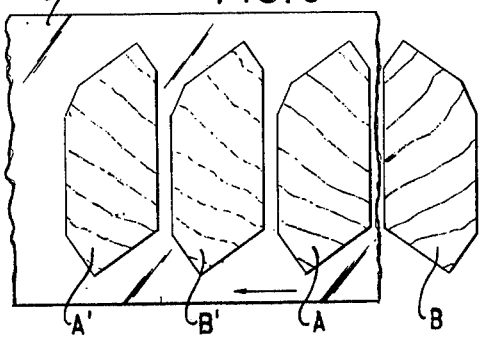

Further features and advantages will be apparent from the following description of the Figures. In the drawing FIG. 1 is a schematic and perspective view of one embodiment of a device in accordance with the invention, FIG. 2 is a cross-sectional view of the cutting station and part of the transport mechanism of the device shown in FIG. 1, FIGS. 3 and 4 are cross-sectional views of the tape reel and the associated table in consecutive stages of the winding process, FIGS. 5 and 6 are plan views of tobacco leaf portions to be cut and of the orientation on a winding reel respectively.

Figure 1:
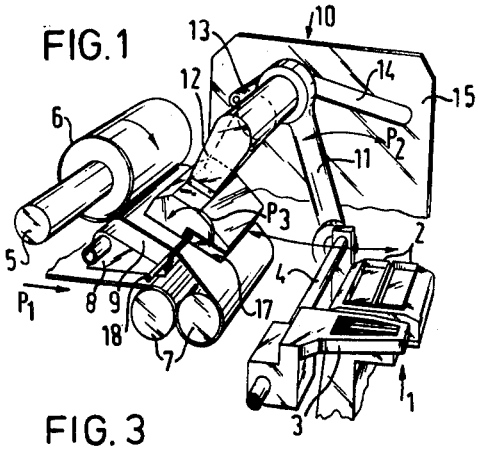

The device shown in FIG. 1 mainly comprises a cutting station 1 equipped with a pair of cutting beds 2, along the cutting edges of which the rollers 3 are passed with the aid of the straight guide 4.

The device comprises furthermore on the left-hand side of the cutting station a reel 5, on which an airpermeable tape 6 is wound so that the tape moves in the direction of the arrow P1. The tape is first passed between clamping rollers 7 and subsequently across a suction table 8, the supporting face 9 of which supports and guides the tape 6 before it is wound on the reel 5.

A transport mechanism 10 serves to transfer the tobacco leaf portions cut out inside the cutting edges of the cutting beds 2 to the supporting face 9 of the table 8 so that the leaf portions are deposited on the upper surface of the tape 6 and can subsequently be stored between the turns thereof.

The transport mechanism 10 in the embodiment shown comprises a pivotable arm 11, which is reciprocated by a driving mechanism (not shown) in the direction of the arrow P2. The top end of the arm 11 holds a pivotable suction head 12, which is controlled by a cam arm 13, the cam of which runs in the cam slot 14 of a stationary guide plate 15. The proportions are chosen so that by a turn of the arm 11 the suction head 12 approaches by the bottom surface 16 (see FIG. 2) at right angles the cutting beds 2 of the cutting station 1 as well as the supporting face 9 of the table 8.

The transport mechanism 10 is furthermore equipped with an orientating member 17, which is formed as shown in FIG. 1 by an auxiliary suction table, which is capable of tilting about an axis 18 extending parallel to the face 9. The auxiliary table 17 is mainly located at the side of the table 8, but it is tilted through 180° down to the supporting face 9 of the table 8 in the direction of the arrow P3 by a driving mechanism (not shown).

In order to ensure a simultaneous transfer to tobacco leaf portions from the suction head 12 to the supporting face 9 and to the auxiliary table 17 the bottom surface 16 of the suction head 12 in this embodiment has a stepped structure as is shown in FIG. 2.

The device operates as follows. A tobacco leaf, for example, a whole leaf (see FIG. 5) is deposited on the cutting station 1 so that the main rib extends between the neighbouring edges of the cutting beds 2. The cutting beds have each the desired shape and are disposed in specularly symmetrical relationship near the cutting station 1. After the cutting rollers 3 have punched the portion out of the tobacco leaf, the suction head 12 arrives above the cutting station 1 and picks up the portions A and B (see FIG. 6) from the cutting station 1 and transfers these portions to the table 8. The portion A is directly pressed down on the supporting face 9, that is to say, on the path 6, whereas the portion B arrives at the surface of the auxiliary table 17 (see FIG. 3). After the suction head 12 is removed, the auxiliary table 17 is tilted over in the direction of the arrow P3, after the belt 6 has advanced over a given distance so that the portion B is deposited in the reversed state on the belt 6. This is illustrated in FIG. 6 and designated by A', B'. From FIG. 6 it will be apparent that all leaf portions are orientated similarly on the belt 6.

The invention is not limited to the embodiments described above, since the orientating member 17 may have any shape. For example, similarly shaped leaf portions may be cut from half a tobacco leaf, all of which are simultaneously picked up by a suction head 12 provided, for example, with an orientating member adapted to rotate about an axis at right angles to the surface 16. This orientating member can arrange one leaf portion in the same configuration as a further leaf portion.

An orientating member 17 may furthermore be pivotable about an axis 18 occupying a different position than that shown, for example, at right angles thereto.

What is claimed is:

1. A device for winding a web of indefinite length into a coil while storing a plurality of similarly shaped tobacco leaf portions between successive layers of the coil in predetermined relationship with respect to the web wherein said leaf portions are similarly oriented with respect to the web but are disposed at regularly spaced intervals longitudinally thereof, comprising in combination:

winding means for receiving a web of indefinite length and winding it into a coil;

means for supplying the web to said winding means whereby the web continuously presents a flat receiving surface immediately prior to being coiled;

a cutting station disposed in spaced relation to said receiving surface and comprising at least two cutting dies which simultaneously cut tobacco leaf portions of the same geometrical shape but having a spatial relationship to each other different from said predetermined relationship; and means for transporting the tobacco leaf portions from the cutting station to said receiving surface of the web and for arranging them thereon in said predetermined relationship.

2. A device as defined in claim 1 wherein said means for transporting and arranging comprises a suction head for simultaneously picking up said tobacco leaf portions from said cutting dies.

3. A device as defined in claim 1 or 2 wherein said cutting dies are arranged to cut tobacco leaf portions which are mirror symmetrical images.

4. A device as defined in claim 3 wherein said means for transporting and arranging includes an auxiliary suction table pivotally mounted adjacent said receiving surface for inverting one of said tobacco leaf portions and depositing it on said receiving surface.

* * * * *